US007042316B2

(12) United States Patent
Shamsaifar et al.

(10) Patent No.: US 7,042,316 B2
(45) Date of Patent: May 9, 2006

(54) WAVEGUIDE DIELECTRIC RESONATOR ELECTRICALLY TUNABLE FILTER

(75) Inventors: Khosro Shamsaifar, Ellicott City, MD (US); Vladimir Keis, St. Petersburg (RU); Andrey Kozyrev, St. Petersburg (RU)

(73) Assignee: Paratek Microwave, Inc., Columbia, MD (US)

( * ) Notice: Subject to any disclaimer, the term of this patent is extended or adjusted under 35 U.S.C. 154(b) by 35 days.

(21) Appl. No.: 10/837,100

(22) Filed: Apr. 30, 2004

(65) Prior Publication Data

US 2005/0030132 A1 Feb. 10, 2005

Related U.S. Application Data

(60) Provisional application No. 60/467,060, filed on May 1, 2003.

(51) Int. Cl.
*H01P 1/207* (2006.01)

(52) U.S. Cl. ..... 333/209; 333/208

(58) Field of Classification Search ..... 333/205, 333/208–210

See application file for complete search history.

(56) References Cited

U.S. PATENT DOCUMENTS

| | | | | |
|---|---|---|---|---|
| 4,675,631 | A * | 6/1987 | Waggett | 333/210 |
| 5,004,993 | A * | 4/1991 | Reindel | 333/208 |
| 5,312,790 | A | 5/1994 | Sengupta et al. | 501/137 |
| 5,427,988 | A | 6/1995 | Sengupta et al. | 501/137 |
| 5,459,123 | A * | 10/1995 | Das | 505/210 |
| 5,486,491 | A | 1/1996 | Sengupta et al. | 501/137 |
| 5,593,495 | A | 1/1997 | Masuda et al. | 117/4 |
| 5,635,433 | A | 6/1997 | Sengupta | 501/137 |
| 5,635,434 | A | 6/1997 | Sengupta | 501/138 |
| 5,640,042 | A | 6/1997 | Koscica et al. | 257/595 |
| 5,693,429 | A | 12/1997 | Sengupat et al. | 428/699 |
| 5,694,134 | A | 12/1997 | Barnes | 343/700 |
| 5,766,697 | A | 6/1998 | Sengupta et al. | 427/585 |
| 5,830,591 | A | 11/1998 | Sengupta et al. | 428/701 |
| 5,846,893 | A | 12/1998 | Sengupta et al. | 501/137 |
| 5,886,867 | A | 3/1999 | Chivukula et al. | 361/311 |
| 5,990,766 | A | 11/1999 | Zhang et al. | 333/205 |
| 6,074,971 | A | 6/2000 | Chiu et al. | 501/139 |
| 6,377,142 | B1 | 4/2002 | Chiu et al. | 333/238 |
| 6,377,217 | B1 | 4/2002 | Zhu et al. | 343/700 |
| 6,377,440 | B1 | 4/2002 | Zhu et al. | 361/311 |
| 6,404,614 | B1 | 6/2002 | Zhu et al. | 361/277 |
| 6,492,883 | B1 | 12/2002 | Liang et al. | 333/132 |
| 6,514,895 | B1 | 2/2003 | Chiu et al. | 501/137 |
| 6,525,630 | B1 | 2/2003 | Zhu et al. | 333/205 |
| 6,531,936 | B1 | 3/2003 | Chiu et al. | 333/164 |
| 6,535,076 | B1 | 3/2003 | Partridge et al. | 333/17.1 |
| 6,538,603 | B1 | 3/2003 | Chen et al. | 342/372 |
| 6,556,102 | B1 | 4/2003 | Sengupta et al. | 333/161 |
| 6,590,468 | B1 | 7/2003 | du Toit et al. | 333/17.3 |
| 6,597,265 | B1 | 7/2003 | Liang et al. | 333/204 |
| 6,724,280 | B1 * | 4/2004 | Shamsaifar et al. | 333/209 |

* cited by examiner

*Primary Examiner*—Seungsook Ham
(74) *Attorney, Agent, or Firm*—James S. Finn

(57) ABSTRACT

A tunable filter which may include at least one resonator. The at least one resonator may comprise a ring resonator made on a dielectric substrate placed in a waveguide, wherein the waveguide may contain a cut-off portion which houses and shields at least one resonator containing at least one tunable capacitor therein. A DC Bias circuit may be connected to the at least one resonator and may be capable of providing DC bias to the at least one tunable capacitor.

13 Claims, 1 Drawing Sheet

WAVEGUIDE DIELECTRIC RESONATOR ELECTRICALLY TUNABLE FILTER

CROSS REFERENCE TO A RELATED APPLICATION

This application claims the benefit of U.S. Provisional Application Ser. No. 60/467,060, filed May 1, 2003, entitled, "Waveguide Dielectric Resonator Electronically Tunable Filter."

BACKGROUND OF INVENTION

Electronically tunable microwave filters have found wide applications in microwave systems. Compared to mechanically and magnetically tunable filters, electronically tunable filters have an advantage of fast tuning capability over wide band applications. Because of this advantage, they can be used in the applications such as cellular, PCS (personal communication system), Point to Point, Point to multipoint, LMDS (local multipoint distribution service), frequency hopping, satellite communication, and radar systems. In the electronically tunable filters, filters may be divided into two types: one is a dielectric capacitor based tunable filter and the other is semiconductor varactor based tunable filter. Compared to semiconductor varactor based tunable filters, tunable dielectric capacitor based tunable filters have the merits of lower loss, higher power-handling, and higher IP3, specifically at higher frequencies.

Thus, there is a strong need for tunable filters which have low insertion loss, fast tuning speed, and high power handling.

SUMMARY OF THE INVENTION

The present invention provides a tunable filter which may include at least one resonator. The at least one resonator may comprise a ring resonator made on a dielectric substrate placed in a waveguide, wherein the waveguide may contain a cut-off portion which houses and shields at least one resonator containing at least one tunable capacitor therein. A DC Bias circuit may be connected to the at least one resonator and may be capable of providing DC bias to the at least one tunable capacitor.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
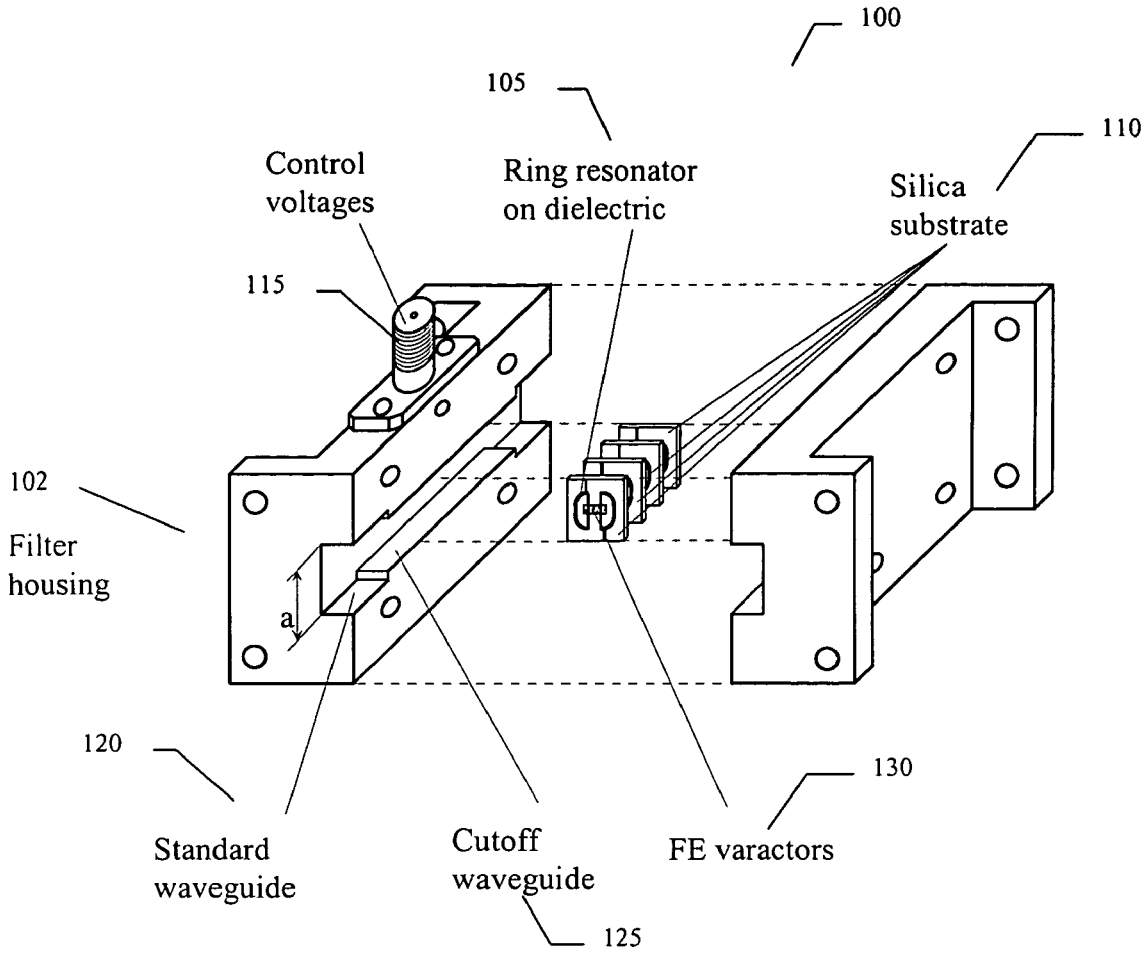
FIG. 1 shows the Layout of a four-pole waveguide—dielectric resonator filter.

It will be appreciated that for simplicity and clarity of illustration, elements illustrated in the FIGURES have not necessarily been drawn to scale. For example, the dimensions of some of the elements are exaggerated relative to other elements for clarity. Further, where considered appropriate, reference numerals have been repeated among the FIGURESS to indicate corresponding or analogous elements.

DETAILED DESCRIPTION OF THE INVENTION

Tunable filters have been developed for radio frequency applications. They may be tuned electronically by using either dielectric varactors or Micro-electro-mechanical systems (MEMS) based varactors. Tunable filters offer service providers flexibility and scalability, which were never possible before. A single tunable filter solution enables radio manufacturers to replace several fixed filters covering adjacent frequencies. This versatility provides front-end RF tunability in real time applications and decreases deployment and maintenance costs through software controls and reduced component count. Also, fixed filters need to be wide band so that total number of filters to cover desired frequency range does not exceed reasonable numbers. Tunable filters, however, may be narrow band and may be tuned in the field by remote command. Additionally, narrowband filters at the front end are appreciated from the systems point of view, because they may provide better selectivity and may help reduce interference from nearby transmitters. Two of such filters can be combined in a diplexer or duplexer configuration.

Inherent in every tunable filter may be the ability to rapidly tune the response using high-impedance control lines. The assignee of the present invention's, Parascan® materials technology enables these tuning properties, as well as, high Q values resulting low losses and extremely high IP3 characteristics, even at high frequencies. Also, tunable filters based on MEMS technology can be used for these applications. They use different bias voltages to vary the electrostatic force between two parallel plates of the varactor and hence change its capacitance value. They show lower Q than dielectric varactors, but can be used successfully for low frequency applications.

The term Parascan® as used herein is a trademarked word indicating a tunable dielectric material developed by the assignee of the present invention. Parascan® tunable dielectric materials have been described in several patents. Barium strontium titanate ($BaTiO_3$—$SrTiO_3$), also referred to as BSTO, is used for its high dielectric constant (200–6,000) and large change in dielectric constant with applied voltage (25–75 percent with a field of 2 Volts/micron). Tunable dielectric materials including barium strontium titanate are disclosed in U.S. Pat. No. 5,312,790 to Sengupta, et al. entitled "Ceramic Ferroelectric Material"; U.S. Pat. No. 5,427,988 by Sengupta, et al. entitled "Ceramic Ferroelectric Composite Material-BSTO-MgO"; U.S. Pat. No. 5,486,491 to Sengupta, et al. entitled "Ceramic Ferroelectric Composite Material—BSTO-$ZrO_2$"; U.S. Pat. No. 5,635,434 by Sengupta, et al. entitled "Ceramic Ferroelectric Composite Material-BSTO-Magnesium Based Compound"; U.S. Pat. No. 5,830,591 by Sengupta, et al. entitled "Multilayered Ferroelectric Composite Waveguides"; U.S. Pat. No. 5,846,893 by Sengupta, et al. entitled "Thin Film Ferroelectric Composites and Method of Making"; U.S. Pat. No. 5,766,697 by Sengupta, et al. entitled "Method of Making Thin Film Composites"; U.S. Pat. No. 5,693,429 by Sengupta, et al. entitled "Electronically Graded Multilayer Ferroelectric Composites"; U.S. Pat. No. 5,635,433 by Sengupta entitled "Ceramic Ferroelectric Composite Material BSTO-ZnO"; U.S. Pat. No. 6,074,971 by Chiu et al. entitled "Ceramic Ferroelectric Composite Materials with Enhanced Electronic Properties BSTO-Mg Based Compound-Rare Earth Oxide". These patents are incorporated herein by reference. The materials shown in these patents, especially BSTO-MgO composites, show low dielectric loss and high tunability. Tunability is defined as the fractional change in the dielectric constant with applied voltage.

Barium strontium titanate of the formula $Ba_xSr_{1-x}TiO_3$ is a preferred electronically tunable dielectric material due to its favorable tuning characteristics, low Curie temperatures and low microwave loss properties. In the formula $Ba_xSr_{1-x}TiO_3$, x can be any value from 0 to 1, preferably from about 0.15 to about 0.6. More preferably, x is from 0.3 to 0.6.

Other electronically tunable dielectric materials may be used partially or entirely in place of barium strontium titanate. An example is $Ba_xCa_{1-x}TiO_3$, where x is in a range from about 0.2 to about 0.8, preferably from about 0.4 to about 0.6. Additional electronically tunable ferroelectrics include $Pb_xZr_{1-x}TiO_3$ (PZT) where x ranges from about 0.0 to about 1.0, $Pb_xZr_{1-x}SrTiO_3$ where x ranges from about 0.05 to about 0.4, $KTa_xNb_{1-x}O_3$ where x ranges from about 0.0 to about 1.0, lead lanthanum zirconium titanate (PLZT), $PbTiO_3$, $BaCaZrTiO_3$, $NaNO_3$, $KNbO_3$, $LiNbO_3$, $LiTaO_3$, $PbNb_2O_6$, $PbTa_2O_6$, $KSr(NbO_3)$ and $NaBa_2(NbO_3)_5$ $KH_2PO_4$, and mixtures and compositions thereof. Also, these materials can be combined with low loss dielectric materials, such as magnesium oxide (MgO), aluminum oxide ($Al_2O_3$), and zirconium oxide ($ZrO_2$), and/or with additional doping elements, such as manganese (MN), iron (Fe), and tungsten (W), or with other alkali earth metal oxides (i.e. calcium oxide, etc.), transition metal oxides, silicates, niobates, tantalates, aluminates, zirconnates, and titanates to further reduce the dielectric loss.

In addition, the following U.S. Patent Applications, assigned to the assignee of this application, disclose additional examples of tunable dielectric materials: U.S. application Ser. No. 09/594,837 (U.S. Pat. No. 6,514,895) filed Jun. 15, 2000, entitled "Electronically Tunable Ceramic Materials Including Tunable Dielectric and Metal Silicate Phases"; U.S. application Ser. No. 09/768,690 (U.S. Pat. No. 6,774,077) filed Jan. 24, 2001, entitled "Electronically Tunable, Low-Loss Ceramic Materials Including a Tunable Dielectric Phase and Multiple Metal Oxide Phases"; U.S. application Ser. No. 09/882,605 (U.S. Pat. No. 6,737,179) filed Jun. 15, 2001, entitled "Electronically Tunable Dielectric Composite Thick Films And Methods Of Making Same"; U.S. application Ser. No. 09/834,327 (U.S. Pat. No. 6,617,062) filed Apr. 13, 2001, entitled "Strain-Relieved Tunable Dielectric Thin Films"; and U.S. Provisional Application Ser. No. 60/295,046 filed Jun. 1, 2001 entitled "Tunable Dielectric Compositions Including Low Loss Glass Frits". These patent applications are incorporated herein by reference.

The tunable dielectric materials can also be combined with one or more non-tunable dielectric materials. The non-tunable phase(s) may include MgO, $MgAl_2O_4$, $MgTiO_3$, $Mg_2SiO_4$, $CaSiO_3$, $MgSrZrTiO_6$, $CaTiO_3$, $Al_2O_3$, $SiO_2$ and/or other metal silicates such as $BaSiO_3$ and $SrSiO_3$. The non-tunable dielectric phases may be any combination of the above, e.g., MgO combined with $MgTiO_3$, MgO combined with $MgSrZrTiO_6$, MgO combined with $Mg_2SiO_4$, MgO combined with $Mg_2SiO_4$, $Mg_2SiO_4$ combined with $CaTiO_3$ and the like.

Additional minor additives in amounts of from about 0.1 to about 5 weight percent can be added to the composites to additionally improve the electronic properties of the films. These minor additives include oxides such as zirconnates, tannates, rare earths, niobates and tantalates. For example, the minor additives may include $CaZrO_3$, $BaZrO_3$, $SrZrO_3$, $BaSnO_3$, $CaSnO_3$, $MgSnO_3$, $Bi_2O_3/2SnO_2$, $Nd_2O_3$, $Pr_7O_{11}$, $Yb_2O_3$, $Ho_2O_3$, $La_2O_3$, $MgNb_2O_6$, $SrNb_2O_6$, $BaNb_2O_6$, $MgTa_2O_6$, $BaTa_2O_6$ and $Ta_2O_3$.

Thick films of tunable dielectric composites can comprise $Ba_{1-x}Sr_xTiO_3$, where x is from 0.3 to 0.7 in combination with at least one non-tunable dielectric phase selected from MgO, $MgTiO_3$, $MgZrO_3$, $MgSrZrTiO_6$, $Mg_2SiO_4$, $CaSiO_3$, $MgAl_2O_4$, $CaTiO_3$, $Al_2O_4$, $CaTiO_3$, $Al_2O_3$, $SiO_2$, $BaSiO_3$ and $SrSiO_3$. These compositions can be BSTO and one of these components, or two or more of these components in quantities from 0.25 weight percent to 80 weight percent with BSTO weight ratios of 99.75 weight percent to 20 weight percent.

The electronically tunable materials can also include at least one metal silicate phase. The metal silicates may include metals from Group 2A of the Periodic Table, i.e., Be, Mg, Ca, Sr, Ba and Ra, preferably Mg, Ca, Sr and Ba. Preferred metal silicates include $Mg_2SiO_4$, $CaSiO_3$, $BaSiO_3$ and $SrSiO_3$. In addition to Group 2A metals, the present metal silicates may include metals from Group 1A, i.e., Li, Na, K, Rb, Cs and Fr, preferably Li, Na and K. For example, such metal silicates may include sodium silicates such as $Na_2SiO_3$ and $NaSiO_3$-$5H_2O$, and lithium-containing silicates such as $LiAlSiO_4$, $Li_2SiO_3$ and $Li_4SiO_4$. Metals from Groups 3A, 4A and some transition metals of the Periodic Table may also be suitable constituents of the metal silicate phase. Additional metal silicates may include $Al_2Si_2O_7$, $ZrSiO_4$, $KalSi_3O_8$, $NaAlSi_3O_8$, $CaAl_2Si_2O_8$, $CaMgSi_2O_6$, $BaTiSi_3O_9$ and $Zn_2SiO_4$. The above tunable materials can be tuned at room temperature by controlling an electric field that is applied across the materials.

In addition to the electronically tunable dielectric phase, the electronically tunable materials can include at least two additional metal oxide phases. The additional metal oxides may include metals from Group 2A of the Periodic Table, i.e., Mg, Ca, Sr, Ba, Be and Ra, preferably Mg, Ca, Sr and Ba. The additional metal oxides may also include metals from Group 1A, i.e., Li, Na, K, Rb, Cs and Fr, preferably Li, Na and K. Metals from other Groups of the Periodic Table may also be suitable constituents of the metal oxide phases. For example, refractory metals such as Ti, V, Cr, Mn, Zr, Nb, Mo, Hf, Ta and W may be used. Furthermore, metals such as Al, Si, Sn, Pb and Bi may be used. In addition, the metal oxide phases may comprise rare earth metals such as Sc, Y, La, Ce, Pr, Nd and the like.

The additional metal oxides may include, for example, zirconnates, silicates, titanates, aluminates, stannates, niobates, tantalates and rare earth oxides. Preferred additional metal oxides include $Mg_2SiO_4$, MgO, $CaTiO_3$, $MgZrSrTiO_6$, $MgTiO_3$, $MgAl_2O_4$, $WO_3$, $SnTiO_4$, $ZrTiO_4$, $CaSiO_3$, $CaSnO_3$, $CaWO_4$, $CaZrO_3$, $MgTa_2O_6$, $MgZrO_3$, $MnO_2$, PbO, $Bi_2O_3$ and $La_2O_3$. Particularly preferred additional metal oxides include $Mg_2SiO_4$, MgO, $CaTiO_3$, $MgZrSrTiO_6$, $MgTiO_3$, $MgAl_2O_4$, $MgTa_2O_6$ and $MgZrO_3$.

The additional metal oxide phases are typically present in total amounts of from about 1 to about 80 weight percent of the material, preferably from about 3 to about 65 weight percent, and more preferably from about 5 to about 60 weight percent. In one preferred embodiment, the additional metal oxides comprise from about 10 to about 50 total weight percent of the material. The individual amount of each additional metal oxide may be adjusted to provide the desired properties. Where two additional metal oxides are used, their weight ratios may vary, for example, from about 1:100 to about 100:1, typically from about 1:10 to about 10:1 or from about 1:5 to about 5:1. Although metal oxides in total amounts of from 1 to 80 weight percent are typically used, smaller additive amounts of from 0.01 to 1 weight percent may be used for some applications.

The additional metal oxide phases can include at least two Mg-containing compounds. In addition to the multiple Mg-containing compounds, the material may optionally include Mg-free compounds, for example, oxides of metals selected from Si, Ca, Zr, Ti, Al and/or rare earths.

The present invention provides a tunable filter in dielectric resonator form in a waveguide. The tuning elements may be voltage-controlled tunable dielectric capacitors or MEMS varactors placed on the resonator lines of each filter. Since tunable dielectric capacitors may show high Q, high IP3 (low inter-modulation distortion) and low cost, the tunable filters in the present invention may have the advantage of low insertion loss, fast tuning speed, and high power handling. It may also be low-cost and provide fast tuning.

The present invention further provides a voltage-tuned filter having high Q, low insertion loss, fast tuning speed, high power-handling capability, high IP3 and low cost in the microwave frequency range. Compared to voltage-controlled semiconductor varactors, voltage-controlled tunable dielectric capacitors have higher Q factors, higher power-handling capability and higher third order intercept point (IP3). Voltage-controlled tunable diode varactors or voltage controlled MEMS varactors can also be employed in the filter structure of the present invention.

The tunable dielectric capacitor in the present invention may be made from low loss tunable dielectric film. The range of Q-factor of the tunable dielectric capacitor is between 50, for very high tuning material, and 300, for low tuning materials. It may decrease with the increase of the frequency, but even at higher frequencies, say 30 GHz, may have values as high as 100. A wide range of capacitance of the tunable dielectric capacitors is available; for example, and not by way of limitation 0.1 pF to several pF. The tunable dielectric capacitor may be a packaged two-port component, in which tunable dielectric can be voltage-controlled. The tunable film may be deposited on a substrate, such as MgO, LaAlO3, sapphire, Al2O3 and other dielectric substrates. An applied voltage produces an electric field across the tunable dielectric, which produces an overall change in the capacitance of the tunable dielectric capacitor.

The tunable capacitors based on MEMS technology can also be used in the tunable filter and are within the scope of the present invention. At least two varactor topologies can be used, parallel plate and interdigital. In a parallel plate structure, one of the plates is suspended at a distance from the other plate by suspension springs. This distance can vary in response to electrostatic force between two parallel plates induced by applied bias voltage. In the interdigital configuration, the effective area of the capacitor is varied by moving the fingers comprising the capacitor in and out and changing its capacitance value. MEMS varactors have lower Q than their dielectric counterpart, especially at higher frequencies, but may be used in low frequency applications.

This tunable filter may include a rectangular waveguide under cutoff loaded periodically by dielectric plates, each with metalization to incorporate the tuning element, e.g., tunable dielectric capacitor. The input/output interface to the filter may be a standard waveguide flange. Variations of the capacitance of the tunable capacitor may affect the distribution of the electric field in the dielectric resonator, which tunes its resonant frequency, and the center frequency of the filter.

Turning now to FIG. 1, shown generally at 100, is the Layout of a four-pole waveguide—dielectric resonator filter. The tunable filter 100 includes at least one filter housing 102. The at least one filter housing 102 comprising a waveguide 120, wherein the waveguide contains a cut-off portion 125 housing and shielding at least one resonator 105 therein. The at least one resonator 105 comprising a tunable capacitor 130 therein. A DC Bias circuit (not shown, but known to those of ordinary skill in the art) connected to the at least one resonator 105 capable of providing DC bias to said at least one tunable capacitor 130 (also referred to herein as a varactor). Control voltages are shown at 115.

The tunable filter 100 may also include an input waveguide coupled to the at least one resonator 105 through an aperture and an output waveguide coupled to the at least one resonator through an aperture. The resonator 105 may be made from a dielectric block with a metalization layer within the dielectric block and DC Bias lines associated with the metallization layer. The ring resonator on dielectric 105 may comprise a substrate 110 having a low dielectric constant of $\in_r<25$ with planar surfaces and a metalization layer on the substrate 110. Further, the ring resonator may include at least one tunable capacitor (FE varactors) 130 that may include a metallic electrode with predetermined length, width, and gap distance and a low loss isolation material capable of isolating an outer bias metallic contact and a metallic electrode on a tunable dielectric film.

The aforementioned DC bias circuit may be made from a PCB board with a bias circuit, and may include a lowpass filter capable of isolating an RF signal from the DC bias circuit. It may also include a DC block capacitor associated with the DC bias circuit and a DC connector connected to the DC bias circuit.

By providing the integration of the varactor (again used interchangeable with tunable capacitor) the center frequency of the tunable filter may be tuned by varying the voltage, thereby changing the varactor capacitance. Also, the tunable capacitor may comprise a MEMS variable capacitor or a semiconductor diode varactor variable capacitor. The MEMS variable capacitor may be made in parallel or interdigital topologies.

The present invention further provides in one embodiment of the present invention an article comprising a storage medium having stored thereon instructions, that, when executed by a computing platform, appropriately tunes a filter 100 by establishing a voltage level to be provided to a varactor 130, said varactor 130 part of the tunable filter 100, the tunable filter 100 comprising: at least one filter housing, said at least one filter housing 102 comprising: a waveguide 120, wherein said waveguide 120 contains a cut-off portion 125 housing and shielding at least one resonator 105 therein, said resonator 105 including at least one tunable capacitor 130; and a DC Bias circuit connected to said at least one resonator 105 capable of providing DC bias to said at least one tunable capacitor 130.

While the present invention has been described in terms of its preferred embodiments, those skilled in the art will recognize that various other filters can be constructed in accordance with the invention as defined by the claims.

The invention claimed is:

1. A tunable filter comprising:

at least one filter housing, said at least one filter housing comprising:

a waveguide, wherein said waveguide contains a cut-off portion housing and shielding at least one resonator therein, said resonator including at least one tunable capacitor; and a DC Bias circuit connected to said at least one resonator capable of providing DC bias to said at least one tunable capacitor.

2. The tunable filter of claim 1, further comprising:

an input waveguide coupled to said at least one resonator through an aperture; and an output waveguide coupled to said at least one resonator through an aperture.

3. The tunable filter of claim 1, wherein said tunable capacitor comprises a MEMS variable capacitor.

4. The tunable filter of claim 1, wherein said tunable capacitor comprises a semiconductor diode varactor.

5. The tunable filter of claim 3, wherein said MEMS variable capacitor is made in parallel or interdigital topologies.

6. The tunable filter of claim 1, further comprising at least one additional resonator, said at least one additional resonator including a tunable capacitor.

7. The tunable filter of claim 6, wherein additional resonators are capable of being coupled to said at least one additional resonator, said at least one resonator having been coupled to said at least one additional resonator.

8. A method of tuning a filter, comprising:

providing at least one filter housing, said at least one filter housing comprising:

a waveguide, wherein said waveguide contains a cut-off portion housing and shielding at least one resonator therein, said resonator including at least one tunable capacitor; and providing a DC Bias circuit connected to said at least one resonator capable of providing DC bias to said at least one tunable capacitor.

9. The method of claim 8, further comprising:

providing an input waveguide coupled to said at least one resonator through an aperture; and providing an output waveguide coupled to said at least one resonator through an aperture.

10. The method of claim 8, wherein the center frequency of said filter is tuned by varying the voltage, thereby changing varactor capacitance.

11. The method of claim 8, wherein said tunable capacitor comprises a MEMS variable capacitor.

12. An article comprising a storage medium having stored thereon instructions, that, when executed by a computing platform tunes a tunable filter, said tunable filter, comprising:

at least one filter housing, said at least one filter housing comprising:

a waveguide, wherein said waveguide contains a cut-off portion housing and shielding at least one resonator therein, said resonator including at least one tunable capacitor; and a DC Bias circuit connected to said at least one resonator capable of providing DC bias to said at least one tunable capacitor.

13. The article of claim 12, further comprising:

an input waveguide coupled to said at least one resonator through an aperture; and an output waveguide coupled to said at least one resonator through an aperture.

* * * * *